US009878765B2

(12) United States Patent
McCracken et al.

(10) Patent No.: US 9,878,765 B2
(45) Date of Patent: Jan. 30, 2018

(54) WATER WINDOW APPARATUS

(71) Applicants: Ronald R. McCracken, Oceanside, CA (US); John Christopher Toomey, Carlsbad, CA (US); Vicki L. Thompson, Oceanside, CA (US)

(72) Inventors: Ronald R. McCracken, Oceanside, CA (US); John Christopher Toomey, Carlsbad, CA (US); Vicki L. Thompson, Oceanside, CA (U ( * ) Notice: Subject to any disclaimer, the term of this patent is extended or adjusted under 35 U.S.C. 154(b) by 0 days.

(21) Appl. No.: 15/334,952

(22) Filed: Oct. 26, 2016

(65) Prior Publication Data

US 2017/0113767 A1 Apr. 27, 2017

Related U.S. Application Data

(60) Provisional application No. 62/247,161, filed on Oct. 27, 2015.

(51) Int. Cl.
*B63C 11/49* (2006.01)

(52) U.S. Cl.
CPC ..... *B63C 11/49* (2013.01)

(58) Field of Classification Search
CPC ..... B63C 11/49
USPC ..... 114/135
See application file for complete search history.

(56) References Cited

U.S. PATENT DOCUMENTS

| | | | | | |
|---|---|---|---|---|---|
| 4,145,783 | A * | 3/1979 | Rhodes | B63C 11/49 | 114/66 |
| 4,844,595 | A * | 7/1989 | Nealy | G02B 23/22 | 114/66 |
| 5,476,055 | A * | 12/1995 | Hackett | B63C 11/49 | 114/66 |
| 5,599,220 | A * | 2/1997 | Smith | B63C 11/48 | 441/135 |
| 5,685,753 | A * | 11/1997 | Canela | B63B 35/74 | 441/129 |
| 6,241,569 | B1 * | 6/2001 | Harkrider | B63C 11/49 | 114/66 |
| 7,547,238 | B1 * | 6/2009 | Melancon | B63C 11/49 | 441/135 |
| 7,927,164 | B2 * | 4/2011 | Kuchler | B63C 11/49 | 114/66 |
| 9,090,317 | B2 * | 7/2015 | Mulvihill | B63B 35/73 | |
| 9,751,601 | B2 * | 9/2017 | DeBruyn | B63C 11/49 | |
| 2002/0115366 | A1 * | 8/2002 | Harkrider | B63C 11/49 | 441/135 |
| 2006/0252318 | A1 * | 11/2006 | Krantz | B63B 35/58 | 441/35 |
| 2016/0096598 | A1 * | 4/2016 | Harkrider | A47C 15/006 | 441/130 |
| 2017/0113767 | A1 * | 4/2017 | McCracken | B63C 11/49 | |

* cited by examiner

*Primary Examiner* — Lars A Olson
*Assistant Examiner* — Jovon E Hayes
(74) *Attorney, Agent, or Firm* — Maymanat S. Afshar

(57) ABSTRACT

A water window apparatus including a main water window element, and a plurality of retaining flanges, along with interlocking teeth that fixedly communicate with one another to fixedly retain the main water window there between. The main water window is hollow, as well as monolithic and hermetically sealed to maintain its integral buoyancy, and further has a top that includes a magnifying element that imparts magnification when viewed there-through.

20 Claims, 6 Drawing Sheets

SECTION A-A Fig. 3

Fig. 4 DETAIL B

WATER WINDOW APPARATUS

CROSS-REFERENCE TO RELATED APPLICATIONS

This application claims the benefit of U.S. Provisional Application No. 62/247,161, filed on Oct. 27, 2015.

FIELD OF THE INVENTION

The present invention relates to recreational surface water sports and, more specifically, to an apparatus for providing the rider of a bodyboard, stand-up or prone paddleboard, or surfboard with a magnified view of the water environment immediately beneath the respective board, to provide a glimpse of sea life otherwise obscured and to further provide warning of dangers that may be lurking below.

BACKGROUND

Surface water board sports, including surfing, stand-up and prone paddle boarding, and bodyboarding, a sport popularized by surfing enthusiast Tom Morey in the early 1970s when he invented the modern "boogie" bodyboard, have experienced regular and significant increases in participation in the U.S. in recent years. According to the Outdoor Foundation, the leading nonprofit trade organization for the outdoor recreation industry, surface water board sports are among some of the industry's fastest growing markets in the country.

Nearly half of all Americans participated in at least one outdoor activity in 2014: 142 million participants, on a collective 11.8 billion outdoor outings. Of these, stand-up paddle boarding continues to experience the highest year-over-year participation growth, at 38% in the past year, with more than fifty percent of all first time outdoor recreation participants trying stand-up paddle boarding for the first time.

Where surfboards and stand-up paddleboards require users to have the strength, coordination and balance to stand fully erect while riding, bodyboards allow users to ride prone, or on one knee ("drop knee"), allowing for a far broader range of user skill and age levels. And, because of its high degree of accessibility, bodyboarding has become a foundational gateway sport for stand-up paddle boarding and surfing. With a variety of price points and styles, bodyboards are widely available for the novice and the enthusiast alike, and with the short learning curve, bodyboarding has experienced a greater adoption rate among younger participants than the other respective board sport.

Because of the vast range of skills and ages of users in surface water board sports, especially for the young users with limited or undeveloped attention spans, boredom can quickly set-in with routine and regular use. Additionally, for older riders of stand-up and prone paddleboards and surfboards, especially those operated in deeper offshore waters, the dangers of aggressive sea life beneath them can go unnoticed, leading to treacherous results.

For the foregoing reasons, there is a need for a water window apparatus that extends the playablity, interest and safety of the average surface water sports board.

SUMMARY

The present invention, in its many embodiments, provides an apparatus for the unobscured and magnified view of the underwater environment immediately beneath a surface water sports board.

Exemplary embodiments of a water window apparatus comprises a main water window, and a mating pair of retaining flanges, further comprising interlocking teeth that fixedly communicate with one another to fixedly retain the main water window there between.

In one or more exemplary embodiments, the main water window is hollow, as well as monolithic and hermetically sealed to maintain its integral buoyancy, and further comprises a top that includes a magnifying element that imparts magnification when the user views therethrough. The magnifying element further comprises a conventional convex lens, however in one or more exemplary embodiments, the magnifying element is of a Fresnel type lens to reduce the mass, cost and complexity of said magnifying element.

One or more exemplary embodiments of the instant invention further comprise sealing means, configured in the flange retainer elements, accomplished through a combination of sealing channels and corresponding o-ring seals retained therein.

In one or more exemplary embodiments, a water window apparatus comprises a main water window, received by a plurality of retaining flanges, wherein the plurality of retaining flanges further comprises interlocking teeth in a distal relationship with a flared top or a flared bottom of the retaining flanges.

In an embodiment, the main water window is fixedly retained in a surface water sports board through the communication of, and fixed interaction of, the interlocking teeth of the distal portions of the plurality of retaining flanges. In one embodiment, the interlocked and fixedly attached water window assembly forms a watertight seal against the topmost and bottom-most surface of the surface water sport board through the interaction of a plurality of o-ring flange seals and a plurality of o-ring flange seal channels.

In an embodiment, a water window apparatus is configured to be used with a sports water board, the water window apparatus comprising a water window assembly comprising a hollow, hermetically sealed main window element, wherein the main window element comprises a top surface and a bottom surface; the main window element has a main body extending between the top surface and the bottom surface; a plurality of retaining flanges. In another embodiment, the plurality of retaining flanges further comprise a flared top ring and a flared bottom ring, wherein the flared top and the flared bottom rings further comprise a plurality of o-ring channels and a corresponding plurality of o-ring channel seals; and interlocking teeth distal to the flared top and the flared bottom rings.

In yet another embodiment, the main window element is fixedly retained in the sports water board through the communication of the interlocking teeth proximal to the flared top rings and the flared bottom rings of the retaining flanges, whereby the interlocking teeth of the flared top ring of the retaining flange fixedly interlock with the interlocking teeth of the flared bottom ring of the retaining flange.

In another embodiment, the o-ring channel seals retained in the o-ring channels extend around the circumference of the inner diameter and the outer diameter of the flared top ring and the flared bottom ring of the flange retainer to create a watertight seal when firmly seated and under compression from interlocking of the interlocking teeth of the distal portions of the flared top ring and the flared bottom ring of the retaining flange, and wherein the inner diameter of the retaining flange is dimensioned to accommodate the outer diameter of the main window element, such that the main window element can nest and be bound by the inner diameter and the flared top of the retaining flange and by the inner diameter and the flared bottom of the retaining flange, where the main window element extends from the flared top ring of the retaining flange to the flared bottom ring of the retaining flange; and a magnifying element, wherein the magnifying element adjoins at least one of the top surface of the main window element or the bottom surface of the main window element.

In still another embodiment, the window assembly further comprises a mating pair of retaining flanges. And in another embodiment, the magnifying element adjoins the top surface of the main window element. In a further embodiment, the magnifying element adjoins the bottom surface of the main window element. And in another embodiment, the magnifying element adjoins both the top surface and the bottom surface of the main window element.

In one embodiment, the magnifying element comprises a convex lens geometry or a Fresnel configuration.

In other embodiment, the flared top ring and the flared bottom ring are geometric mirrors of one another.

In yet another embodiment, the top surface of the sports board comprises a first end and a second end wherein the water window assembly is located closer to the first end the sports board, such that a user can observe the underwater environment by laying, kneeling or standing on the sports board.

In a further embodiment, the water sports board is selected from the group consisting of a bodyboard, a stand-up or prone paddleboard, and a surfboard.

A water window apparatus configured to be used with a sports water board, the water window apparatus comprising: a water window assembly comprising: a hollow, hermetically sealed main window element, wherein the main window element comprises a top surface and a bottom surface, and wherein the top surface and the bottom surface form a main body of the main window element; a plurality of retaining flanges, wherein the plurality of retaining flanges further comprises: flared top rings and flared bottom rings, wherein the flared top rings and the flared bottom rings further comprise a plurality of o-ring channels and a corresponding plurality of o-ring channel seals; and interlocking teeth distal to the flared top rings and the flared bottom rings; and a magnifying element, wherein the magnifying element adjoins at least one of the top surface or the bottom surface of the main window element.

A water window apparatus configured to be used with a sports water board, the water window apparatus comprising: a water window assembly comprising: a hollow, hermetically sealed main window element, wherein the main window element comprises a top surface and a bottom surface, and wherein the top surface and the bottom surface form a main body of the main window element; two retaining flanges, wherein each one of the two retaining flanges further comprises: a flared top ring and a flared bottom ring, wherein the flared top ring and the flared bottom ring further comprise a plurality of o-ring channels and a corresponding plurality of o-ring channel seals; and interlocking teeth distal to the flared top ring and the flared bottom ring.

In an embodiment, the main window element is fixedly retained in the sports water board through the communication of the interlocking teeth proximal to the flared top ring and the flared bottom ring of the two retaining flanges, whereby the interlocking teeth of the flared top ring of the two retaining flanges fixedly interlock with the interlocking teeth of the flared bottom ring of the two retaining flanges; wherein the o-ring channel seals retained in the o-ring channels extend around the circumference of the inner diameter and the outer diameter of the flared top ring and the flared bottom ring of the two retaining flanges to create a watertight seal when firmly seated and under compression from engaged interlocking of the interlocking teeth of the distally extending portions of the flared top ring and the flared bottom ring of the two retaining flanges.

In another embodiment, the inner diameter of each one of the two retaining flange is dimensioned to accommodate the outer diameter of the main window element, such that the main window element can nest and be bound by the inner diameter and the flared top of each one of the two retaining flanges and by the inner diameter and the flared bottom of each one of the two retaining flanges, wherein the main window element extends from the flared top ring of each one of the two retaining flanges to the flared bottom ring of each one of the two retaining flanges; and a magnifying element, wherein the magnifying element adjoins at least one of the top surface or the bottom surface of the main window element.

In an embodiment, the water window apparatus is configured to be used with a sports water board, the water window apparatus comprising a water window assembly comprising a hollow, hermetically sealed main window element, wherein the main window element comprises a top surface and a bottom surface, and wherein the top surface and the bottom surface form a main body of the main window element; two retaining flanges, wherein each one of the two retaining flanges further comprises: a) a flared top ring and a flared bottom ring, wherein the flared top ring and the flared bottom ring further comprise a plurality of o-ring channels and a corresponding plurality of o-ring channel seals; and b) interlocking teeth distal to the flared top ring and the flared bottom ring.

In another embodiment, the main window element is fixedly retained in the sports water board through the communication of the interlocking teeth proximal to the flared top ring and the flared bottom ring of the two retaining flanges, whereby the interlocking teeth of the flared top ring of the two retaining flanges fixedly interlock with the interlocking teeth of the flared bottom ring of the two retaining flanges; wherein the o-ring channel seals retained in the o-ring channels extend around the circumference of the inner diameter and the outer diameter of the flared top ring and the flared bottom ring of the two retaining flanges to create a watertight seal when firmly seated and under compression from engaged interlocking of the interlocking teeth of the distally extending portions of the flared top ring and the flared bottom ring of the two retaining flanges, and wherein the inner diameter of each one of the two retaining flange is dimensioned to accommodate the outer diameter of the main window element, such that the main window element can nest and be bound by the inner diameter and the flared top of each one of the two retaining flanges and by the inner diameter and the flared bottom of each one of the two retaining flanges.

In an embodiment, the main window element extends from the flared top ring of each one of the two retaining flanges to the flared bottom ring of each one of the two retaining flanges; and a magnifying element, wherein the magnifying element adjoins both the top surface and the bottom surface of the main window element.

BRIEF DESCRIPTION OF THE FIGURES

Exemplary embodiments of the invention will now be described with reference to the accompanying figures.

DETAILED DESCRIPTION

Figure 1:
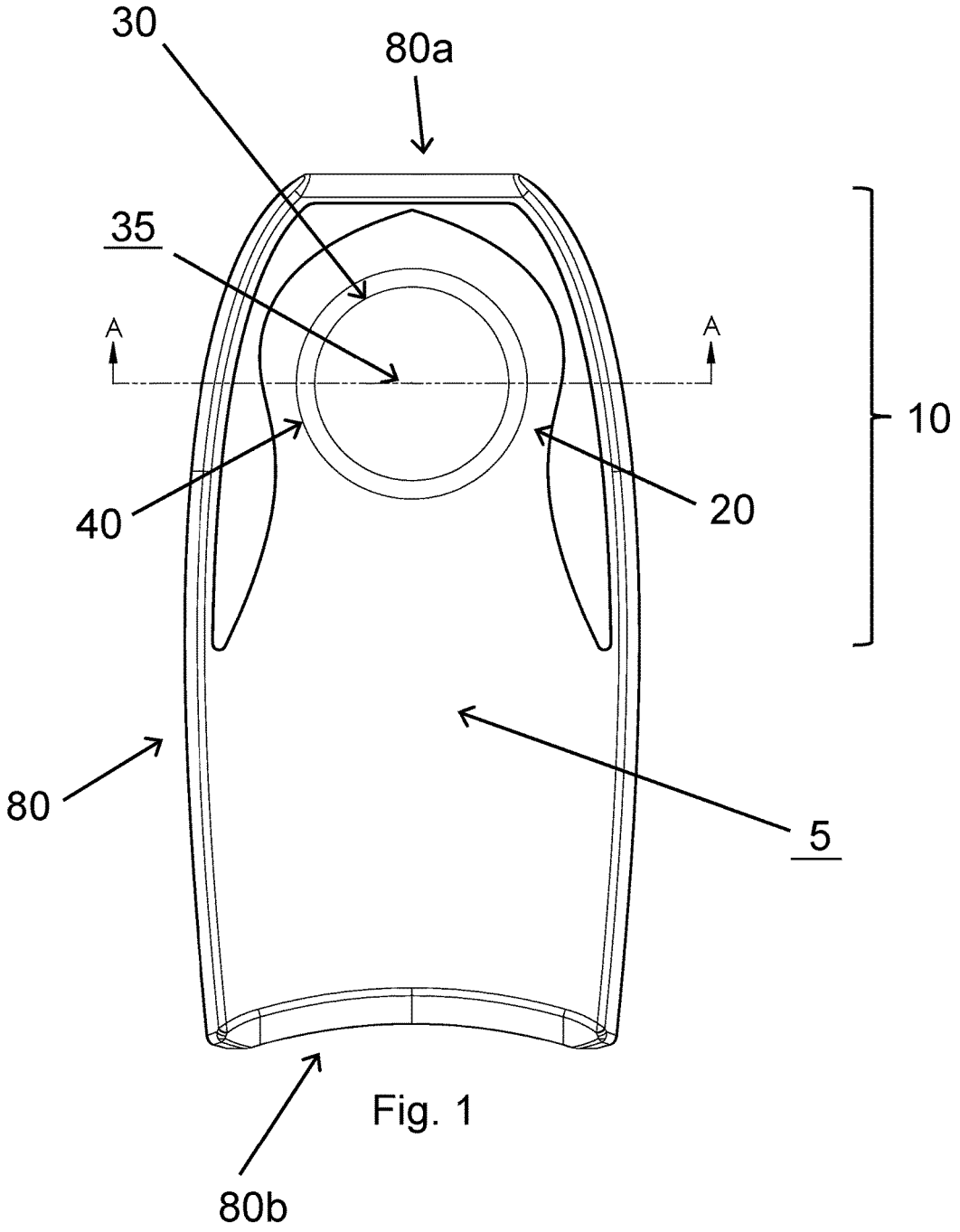
FIG. 1 graphically illustrates a top view of an exemplary embodiment of a water window apparatus integrated into a water board in accordance with the principles of the present invention.

A water window apparatus is designed and manufactured to provide water sports board users the unobscured and magnified view of the underwater environment immediately beneath a surface water sports board. When integrated into a surface water sports board, such as a bodyboard, a paddleboard or a surfboard, the water window apparatus opens-up the underwater world and its sea life, especially abundant in the tidal zones where aforementioned boards are frequently used. In addition, the water window apparatus allows the user quicker notice of possible dangers lurking beneath when aforementioned boards are operated in deep water.

The following detailed description is merely exemplary in nature and is not intended to limit the invention or the application and uses of the invention. As used herein, the word "exemplary" means "serving as an example, instance, or illustration." Thus, any embodiment described herein as "exemplary" is not necessarily to be construed as preferred or advantageous over other embodiments. All of the embodiments described herein are exemplary embodiments provided to enable persons skilled in the art to make or use the invention and not to limit the scope of the invention that is defined by the claims. Furthermore, there is no intention to be bound by any expressed or implied theory presented in the preceding technical field, background, brief summary, or the following detailed description.

As used herein, and unless the context dictates otherwise, the term "water sports board" is intended to include sports board. Therefore, the terms "water sports board", and "sports board", may be used interchangeably.

In this description, reference is made to the drawings, wherein like parts are designated with like reference numerals throughout. As used in the description herein and throughout, the meaning of "a," "an," and "said" includes plural reference unless the context clearly dictates otherwise. Also, as used in the description herein, the meaning of "in" includes "into" and "on", unless the context clearly dictates otherwise.

As used herein, the term "about" in conjunction with a numeral refers to a range of that numeral starting from 10% below the absolute of the numeral to 10% above the absolute of the numeral, inclusive.

Figure 2:
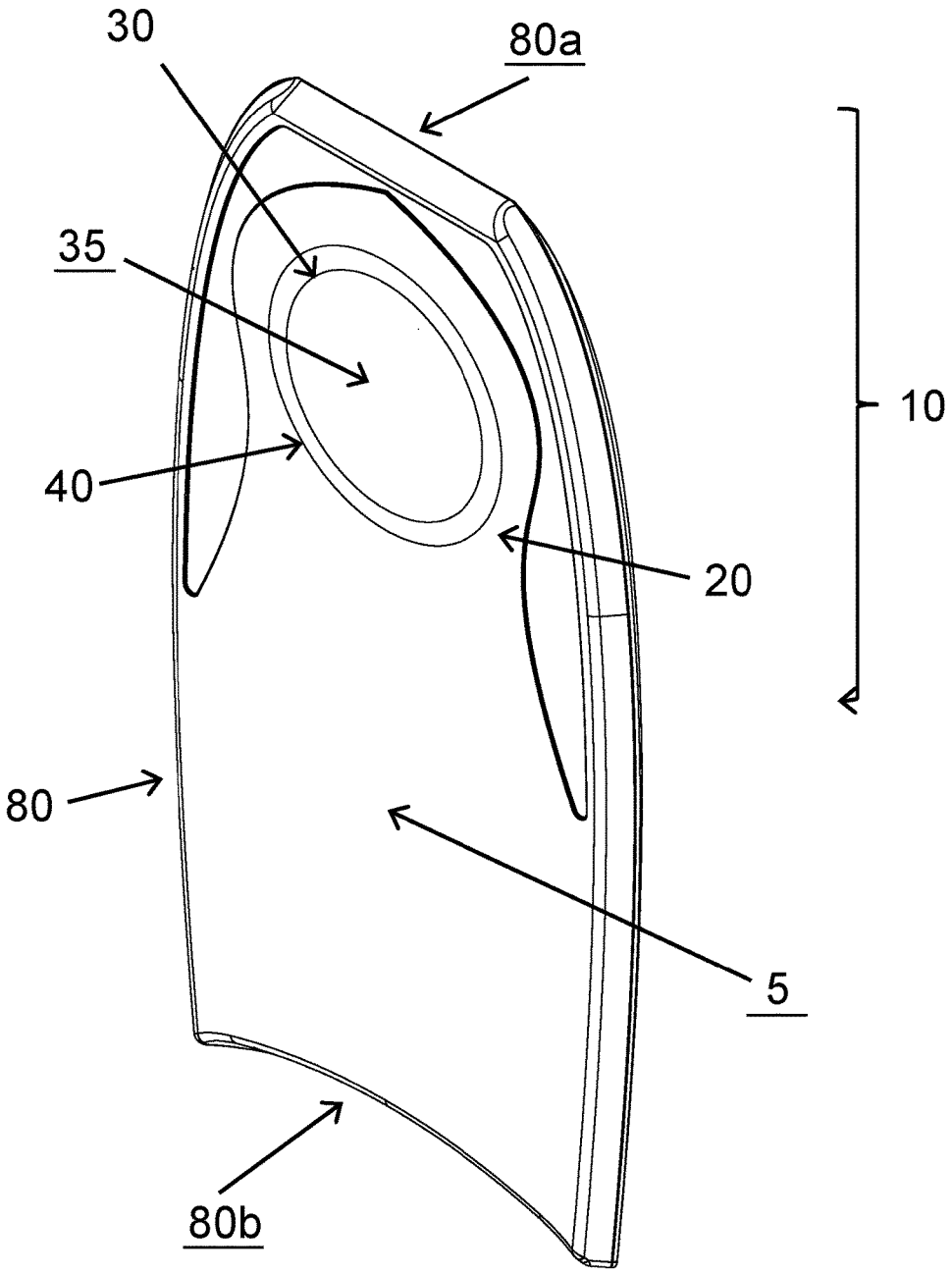
FIG. 2 graphically illustrates an isometric view of an exemplary embodiment of a water window apparatus integrated into a water board in accordance with the principles of the present invention.
Figure 3:
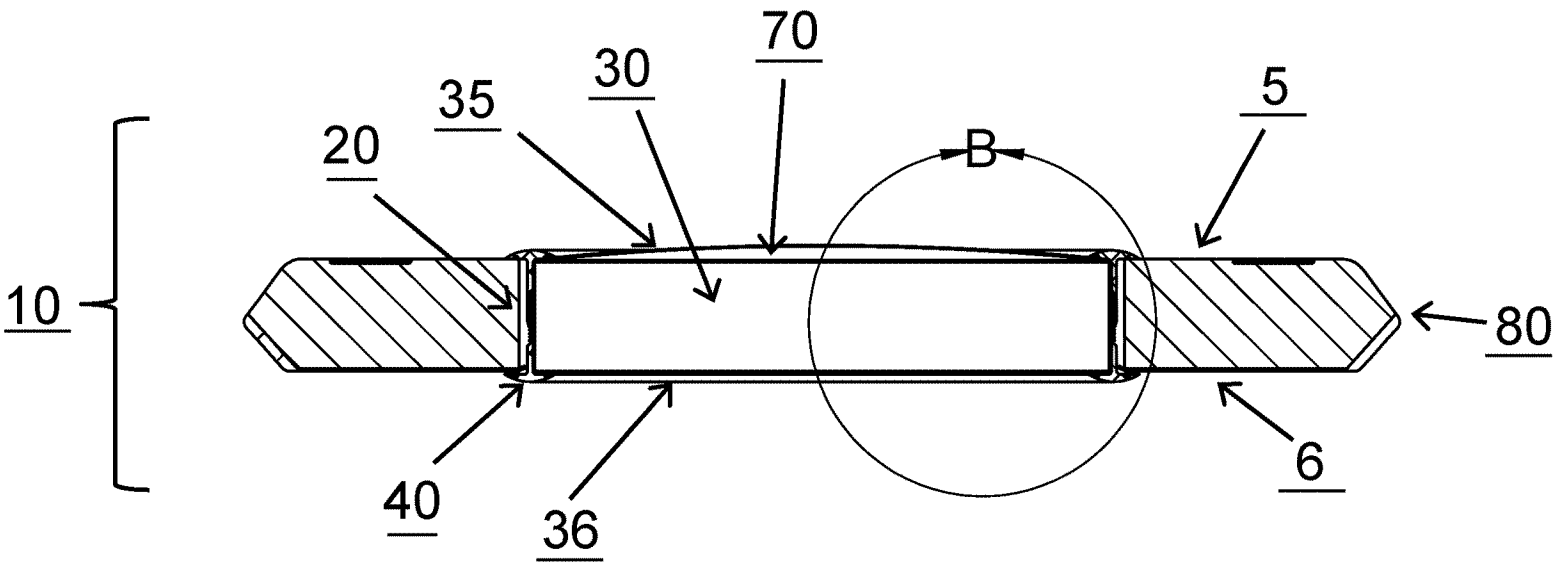
FIG. 3, as an exemplary embodiment, is a cross-sectional view taken on line A-A of FIG. 1.

An exemplary configuration is schematically depicted in FIGS. 1 and 2, in which a water window apparatus 10 is designed and adapted to be used in connection with water sports board 80. In an embodiment, water sports board 80 comprises a top surface 5 and a bottom surface 6 (shown in FIG. 3). In one or more other exemplary embodiments, water window apparatus 10 is used in a bodyboard, a stand-up or prone paddleboard, or a surfboard. In one embodiment, water window apparatus 10 includes water widow assembly 20. In an embodiment, water window assembly 20 includes a hollow, hermetically sealed main window element 30 to maintain water sports board 80 integral buoyancy, and a plurality of retaining flanges 40. In an embodiment, main window element 30 further comprises a top surface 35 and a bottom surface 36 (shown in FIGS. 3-6) that form a main body of the main window element 30. In one embodiment, the top surface 35 of the main window element 30 further comprises a magnifying element 70 (as shown in FIGS. 3-6).

In an embodiment, main window element 30 is manufactured from clear thermoplastic materials. In other embodiments, examples of material of construction include polycarbonate, acrylic, or and combination of the aforementioned materials. In another embodiment, a plurality of retaining flanges 40 are manufactured from suitably rigid and strong materials. Other examples of material of construction include engineering thermoplastics, polycarbonate, acetal, polyester, nylon, blends, or any combination of the aforementioned materials. A skilled person in the art will be readily able to select a suitable material of construction for main window element 30 and retaining flanges 40 based on the operating conditions and requirements in the configurations contemplated herein.

In one embodiment, magnifying element 70 adjoins at least one of the top surface 35 of the main window element 30 or the bottom surface 36 of the main window element 30. In another exemplary embodiment, magnifying element 70 adjoins the top surface 35 of the main window element 30. In still another embodiment, magnifying element 70 adjoins said bottom surface 36 of said main window element 30. In yet another embodiment, magnifying element 70 adjoins both the top surface 35 and the bottom surface 36 of main window element 30.

In another embodiment, magnifying element 70 is fixedly attached to main window element 30, by adhesive, solvent bonding, spin welding, or heat welding, and other physical and/or chemical boding means/methods known in the art.

In one embodiment, magnifying element 70 may comprise conventional convex lens geometry. In another embodiment, magnifying element 70 may comprise a Fresnel configuration to reduce weight, cost and complexity of magnifying element 70. A skilled person in the art will be readily able to select a suitable material of construction for magnifying element 70 based on the operating conditions and requirements in the configurations contemplated herein.

Figure 5:
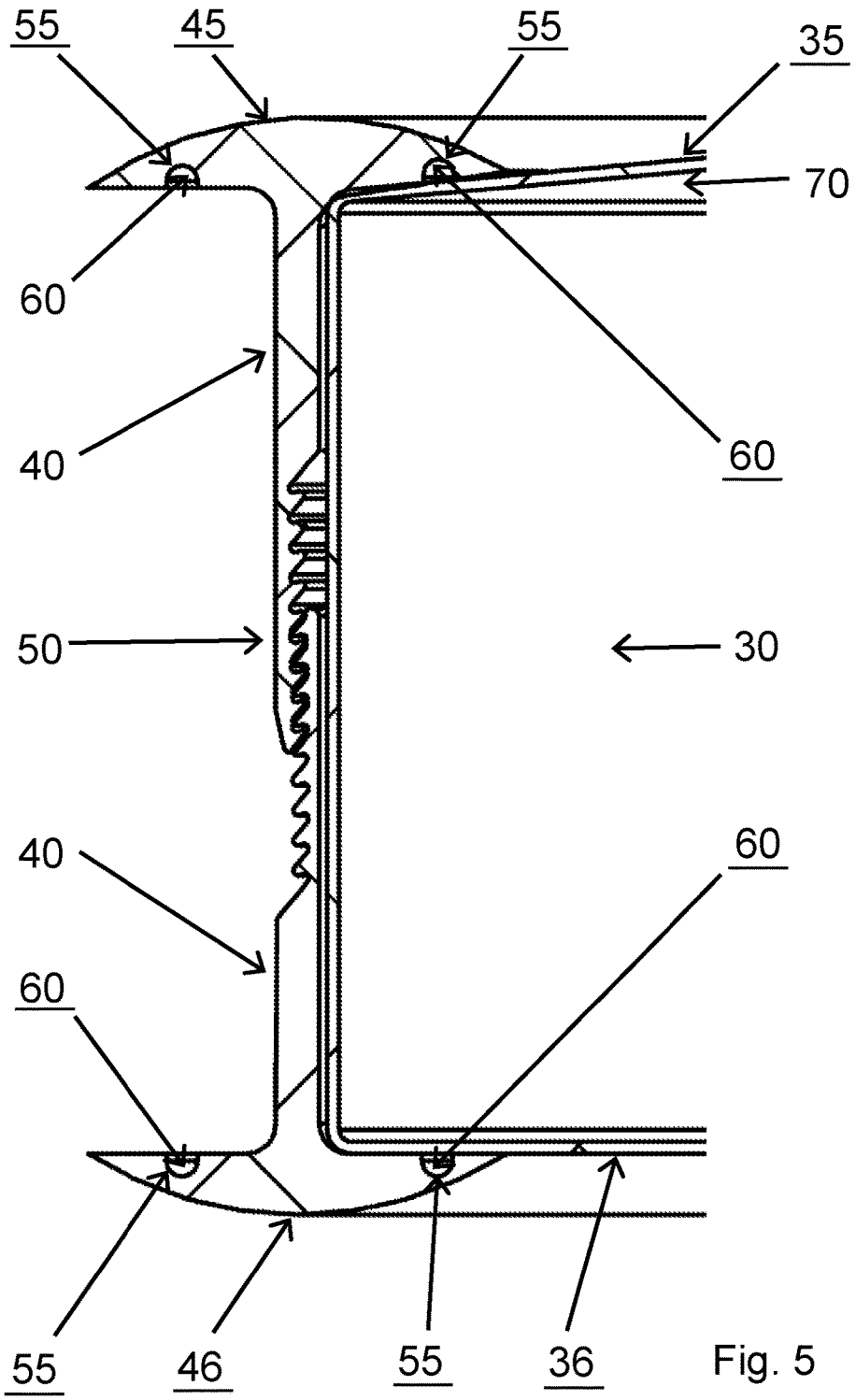
FIG. 5, as an exemplary embodiment, graphically illustrates a finer detail, mirror image close-up, cross-sectional detail view of region B of FIG. 3.

In one embodiment, plurality of retaining flanges 40 further comprise a flared top ring 45 and a flared bottom ring 46, wherein the flared top ring 45 and the flared bottom ring 46 are geometric mirrors of one another. In another embodiment, a plurality of retaining flanges 40 further comprise interlocking teeth 50 distal to the flared top 45 and the flared bottom rings 46 of retaining flanges 40. In one embodiment, the flared top ring 45 and the flared bottom ring 46 of retaining flanges 40 further comprise a plurality of o-ring channels 55 and a corresponding plurality of o-ring channel seals 60 (as shown in FIG. 5). In an exemplary embodiment, o-ring channels 55 and corresponding o-ring channel seals 60 comprise chloroprene (neoprene), buna-n, ethylene propylene diene monomer rubber (EPDM), silicone, or polyurethane.

Figure 4:
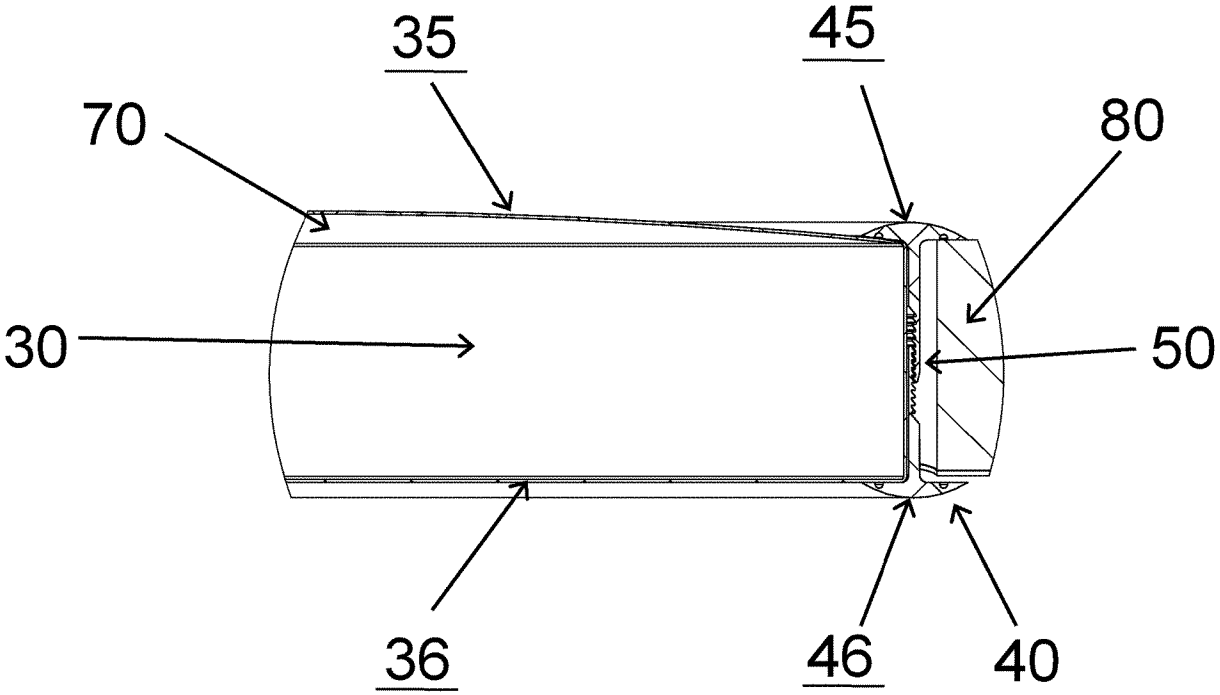
FIG. 4, as an exemplary embodiment, graphically illustrates a close-up, cross-sectional view taken of region B of FIG. 3.
Figure 6:
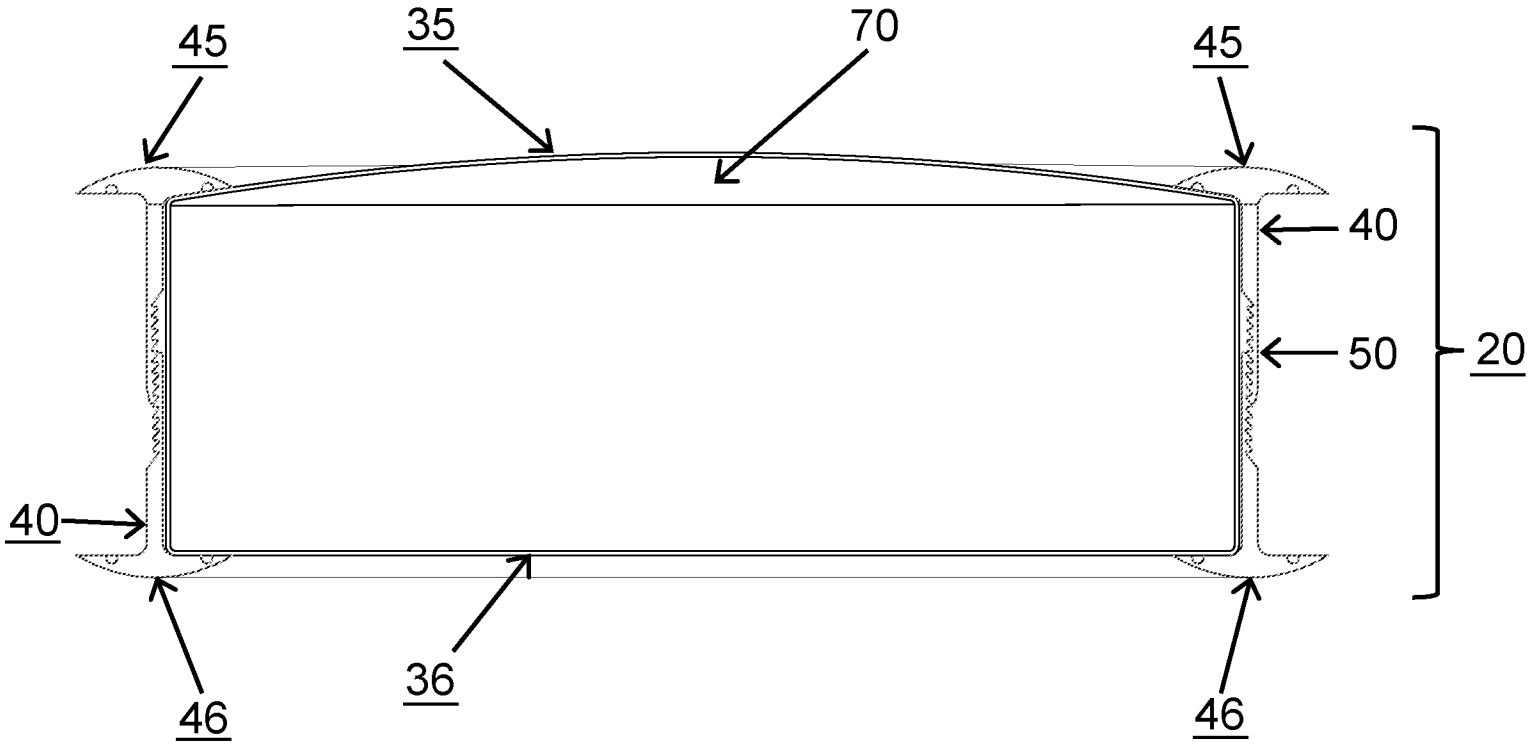
FIG. 6, as an exemplary embodiment, graphically illustrates a finer detailed cross-sectional view taken on Line A-A of FIG. 1.

In another embodiment, main window element 30 is fixedly retained in sports board 80 through the communication of interlocking teeth 50 proximal to the flared top rings 45 and the flared bottom rings 46 of retaining flanges 40, whereby interlocking teeth 50 of flared top ring 45 of retaining flange 40, located at top 5 of sports board 80, fixedly interlocks with interlocking teeth 50 of flared bottom ring 46 of retaining flange 40, located at the bottom 6 of sports board 80 (as shown in FIGS. 4,5 & 6).

In one embodiment, an inner diameter of retaining flange 40 is dimensioned to accommodate an outer diameter of main window element 30, such that main window element 30 can nest and be bound by the inner diameter and the flared top ring 45 of retaining flange 40 and by the inner diameter and the flared bottom ring 46 of retaining flange 40, where main window element 30 extends from the flared top ring 45 of the retaining flange 40, located at the top 5 of sports board 80, to the flared bottom ring 46 of retaining flange 40, located at the bottom 6 of sports board 80.

In another embodiment, o-ring channel seals 60 retained in o-ring channels 55 extend around the circumference of the inner diameter and the outer diameter of flared top ring 45 and the flared bottom ring 46 of retaining flange 40 to create a watertight seal when firmly seated and under compression from engaged interlocking of the interlocking teeth 50 of the distally extending portions of the flared top ring 45 and the flared bottom ring 46 of retaining flange 40 (as shown in FIG. 6).

In an exemplary embodiment, sports board 80 comprises first end 80*a* and second end 80*b*. In one embodiment, water window assembly 20 is located closer to first end 80*a* than second end 80*b* of sports board 80, such that a user can easily observe the underwater environment (as shown in FIGS. 1 and 2) by laying, kneeling or standing on the sports board. A skilled person in the art will readily appreciate the proper position of water window assembly for different sports boards of different dimensions.

In an embodiment, the location of water window assembly 20 depends on the sports board style. In an exemplary embodiment, main water window element 30 is positioned well forward on sports board so that it is in a convenient place for the user's viewing. In another exemplary embodiment, man window element 30 is of a size such that it is sufficiently large enough for providing convenient access to the user's ability to view underwater. For example, in an embodiment, main water window element 30 is about 6 inches in diameter to about 15 inches in diameter. One of ordinary skill in the art can envision other dimensions, which may vary with the type of water sports board or a typical board but not detract from the spirit of the invention.

Thus, specific embodiments of a water window apparatus have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

The invention claimed is:

1. A water window apparatus configured to be used with a sports water board, said water window apparatus comprising:

a water window assembly comprising:

a) a hollow, hermetically sealed main window element, wherein said main window element comprises a top surface and a bottom surface, and wherein said top surface and said bottom surface form a main body of said main window element;

b) a plurality of retaining flanges, wherein said plurality of retaining flanges further comprises:

a) flared top rings and flared bottom rings, wherein said flared top rings and said flared bottom rings further comprise a plurality of o-ring channels and a corresponding plurality of o-ring channel seals; and b) interlocking teeth distal to said flared top rings and said flared bottom rings; and c) a magnifying element, wherein said magnifying element adjoins at least one of said top surface or said bottom surface of said main window element.

2. The apparatus of claim 1, wherein said magnifying element adjoins said top surface of said main window element.

3. The apparatus of claim 1, wherein said magnifying element adjoins said bottom surface of said main window element.

4. The apparatus of claim 1, wherein said magnifying element adjoins both said top surface and said bottom surface of said main window element.

5. The apparatus of claim 1, wherein said magnifying element comprises a convex lens or a Fresnel configuration.

6. The apparatus of claim 1, wherein said flared top ring and said flared bottom ring are geometric mirrors of one another.

7. The apparatus of claim 1, wherein said water sports board is selected from the group consisting of a bodyboard, paddleboard, and a surfboard.

8. A water window apparatus configured to be used with a sports water board, said water window apparatus comprising:

a water window assembly comprising:

a) a hollow, hermetically sealed main window element, wherein said main window element comprises a top surface and a bottom surface, and wherein said top surface and said bottom surface form a main body of said main window element;

b) two retaining flanges, wherein each one of said two retaining flanges further comprises:

a) a flared top ring and a flared bottom ring, wherein said flared top ring and said flared bottom ring further comprise a plurality of o-ring channels and a corresponding plurality of o-ring channel seals; and b) interlocking teeth distal to said flared top ring and said flared bottom ring; and wherein said main window element is fixedly retained in said sports water board through the communication of said interlocking teeth proximal to said flared top ring and said flared bottom ring of said two retaining flanges, whereby said interlocking teeth of said flared top ring of said two retaining flanges fixedly interlock with said interlocking teeth of said flared bottom ring of said two retaining flanges;

wherein said o-ring channel seals retained in said o-ring channels extend around the circumference of an inner diameter and an outer diameter of said flared top ring and said flared bottom ring of said two retaining flanges to create a watertight seal when firmly seated and under compression from engaged interlocking of said interlocking teeth of the distally extending portions of said flared top ring and said flared bottom ring of said two retaining flanges, and wherein the inner diameter of each one of said two retaining flange is dimensioned to accommodate the outer diameter of said main window element, such that said main window element can nest and be bound by said inner diameter and said flared top of each one of said two retaining flanges and by said inner diameter and said flared bottom of each one of said two retaining flanges, wherein said main window element extends from said flared top ring of each one of said two retaining flanges to said flared bottom ring of each one of said two retaining flanges; and c) a magnifying element, wherein said magnifying element adjoins at least one of said top surface or said bottom surface of said main window element.

9. The apparatus of claim 8, wherein said magnifying element adjoins said top surface of said main window element.

10. The apparatus of claim 8, wherein said magnifying element adjoins said bottom surface of said main window element.

11. The apparatus of claim 8, wherein said magnifying element adjoins both said top surface and said bottom surface of said main window element.

12. The apparatus of claim 8, wherein said magnifying element comprises a convex lens or a Fresnel configuration.

13. The apparatus of claim 8, wherein said flared top ring and said flared bottom ring are geometric mirrors of one another.

14. The apparatus of claim 8, wherein said water sports board is selected from the group consisting of a bodyboard, paddleboard, and a surfboard.

15. A water window apparatus configured to be used with a sports water board, said water window apparatus comprising:

a water window assembly comprising:

a) a hollow, hermetically sealed main window element, wherein said main window element comprises a top surface and a bottom surface, and wherein said top surface and said bottom surface form a main body of said main window element;

b) two retaining flanges, wherein each one of said two retaining flanges further comprises:

a) a flared top ring and a flared bottom ring, wherein said flared top ring and said flared bottom ring further comprise a plurality of o-ring channels and a corresponding plurality of o-ring channel seals; and b) interlocking teeth distal to said flared top ring and said flared bottom ring; and wherein said main window element is fixedly retained in said sports water board through the communication of said interlocking teeth proximal to said flared top ring and said flared bottom ring of said two retaining flanges, whereby said interlocking teeth of said flared top ring of said two retaining flanges fixedly interlock with said interlocking teeth of said flared bottom ring of said two retaining flanges;

wherein said o-ring channel seals retained in said o-ring channels extend around the circumference of an inner diameter and an outer diameter of said flared top ring and said flared bottom ring of said two retaining flanges to create a watertight seal when firmly seated and under compression from engaged interlocking of said interlocking teeth of the distally extending portions of said flared top ring and said flared bottom ring of said two retaining flanges, and wherein the inner diameter of each one of said two retaining flange is dimensioned to accommodate the outer diameter of said main window element, such that said main window element can nest and be bound by said inner diameter and said flared top of each one of said two retaining flanges and by said inner diameter and said flared bottom of each one of said two retaining flanges, wherein said main window element extends from said flared top ring of each one of said two retaining flanges to said flared bottom ring of each one of said two retaining flanges; and c) a magnifying element, wherein said magnifying element adjoins both said top surface and said bottom surface of said main window element.

16. The apparatus of claim 15, wherein said magnifying element adjoins said top surface of said main window element.

17. The apparatus of claim 15, wherein said magnifying element adjoins said bottom surface of said main window element.

18. The apparatus of claim 15, wherein said magnifying element comprises a convex lens or a Fresnel configuration.

19. The apparatus of claim 15, wherein said flared top ring and said flared bottom ring are geometric mirrors of one another.

20. The apparatus of claim 15, wherein said water sports board is selected from the group consisting of a bodyboard, paddleboard, and a surfboard.

* * * * *